US006551376B1

(12) United States Patent
Beal

(10) Patent No.: US 6,551,376 B1
(45) Date of Patent: Apr. 22, 2003

(54) METHOD FOR DEVELOPING AND SUSTAINING UNIFORM DISTRIBUTION OF A PLURALITY OF METAL POWDERS OF DIFFERENT DENSITIES IN A MIXTURE OF SUCH METAL POWDERS

(75) Inventor: Harold F. Beal, Rockford, TN (US)

(73) Assignee: Doris Nebel Beal Inter Vivos Patent Trust, Pawleys Island, SC (US)

( * ) Notice: Subject to any disclaimer, the term of this patent is extended or adjusted under 35 U.S.C. 154(b) by 0 days.

(21) Appl. No.: 09/553,687

(22) Filed: Apr. 21, 2000

Related U.S. Application Data

(63) Continuation-in-part of application No. 08/887,774, filed on Jul. 3, 1997, now abandoned, which is a continuation-in-part of application No. 08/843,450, filed on Apr. 16, 1997, now abandoned, which is a continuation-in-part of application No. 08/815,003, filed on Mar. 14, 1997, now Pat. No. 5,822,904.

(51) Int. Cl.[7] ..... C22C 1/05
(52) U.S. Cl. ..... 75/252; 419/37
(58) Field of Search ..... 419/37, 65; 75/252

(56) References Cited

U.S. PATENT DOCUMENTS

| | | | |
|---|---|---|---|
| 33,754 | A | 11/1861 | Sawyer |
| 290,738 | A | 12/1883 | Brown |
| 1,328,334 | A | 1/1920 | Newton |
| 1,732,211 | A | 10/1929 | Olin et al. |
| 1,992,244 | A | 2/1935 | Schuricht |
| 2,393,648 | A | 1/1946 | Martin |
| 3,209,691 | A | 10/1965 | Herter |
| 3,349,711 | A | 10/1967 | Darigo et al. |
| 3,720,170 | A | 3/1973 | Godfrey |
| 3,888,636 | A | 6/1975 | Sczerzenie et al. |
| 3,898,933 | A | 8/1975 | Castera et al. |
| 4,165,692 | A | 8/1979 | Dufort |
| 4,387,492 | A | 6/1983 | Inman |
| 4,428,295 | A | 1/1984 | Urs |
| 4,458,599 | A | 7/1984 | Mullendore et al. |
| 4,498,395 | A | 2/1985 | Kock et al. |
| 4,517,897 | A | 5/1985 | Kneubuhl |
| 4,592,283 | A | 6/1986 | Hellner et al. |
| 4,644,865 | A | 2/1987 | Lawrence |
| 4,716,835 | A | 1/1988 | Leemans |
| 4,753,172 | A | 6/1988 | Katzmann et al. |
| 4,895,077 | A | 1/1990 | Miethlich et al. |
| 4,897,117 | A | 1/1990 | Penrice |

(List continued on next page.)

FOREIGN PATENT DOCUMENTS

| | | |
|---|---|---|
| AT | 57101 | 1/1913 |
| CZ | 80541 | 6/1961 |
| DE | 1116575 | 11/1961 |
| DE | 3835808 | 4/1990 |
| FR | 374726 | 6/1907 |
| GB | 538268 | 7/1941 |
| GB | 861718 | 2/1961 |
| GB | 2278423 | 11/1994 |
| IT | 349795 | 9/1937 |
| WO | 9601407 | 1/1996 |

OTHER PUBLICATIONS

Lymann—Reloading Handbook For Rifle, Pistol, and Muzzle Loading—45$^{th}$ edition.

*Primary Examiner*—Daniel J. Jenkins
(74) *Attorney, Agent, or Firm*—Pitts & Brittian, P.C.

(57) ABSTRACT

A method by which the distribution of the particulates of a plurality of metal powders, the metals of each powder being of different densities, may be uniformly disbursed within a dry mixture of the powders and by which this uniform dispersion of the different density powders can be sustained through subsequent handling and/or storage of the mixture. In accordance with one aspect of the present invention, a quantity of each of a plurality of metal powders is admixed with a dry stabilizing non-metal powder. One particularly useful non-metal powder is a micronized polymer, preferably micronized polyethylene.

20 Claims, 1 Drawing Sheet

U.S. PATENT DOCUMENTS 4,935,200 A 6/1990 LaSalle et al.
4,940,404 A 7/1990 Ammon et al.
4,958,572 A 9/1990 Martel
4,970,960 A 11/1990 Feldmann
5,033,356 A 7/1991 Richardson
5,035,183 A 7/1991 Luxton
5,064,462 A 11/1991 Mullendore et al.
5,078,054 A 1/1992 Ashok et al.
5,079,814 A 1/1992 Moore et al.
5,189,252 A 2/1993 Huffman et al.
5,198,616 A 3/1993 Anderson
5,237,930 A * 8/1993 Belanger et al. ..... 102/529
5,261,941 A 11/1993 Sheinberg
5,264,022 A 11/1993 Haygarth et al.
5,275,108 A 1/1994 Chernicky et al.
5,279,787 A 1/1994 Oltrogge
5,293,822 A 3/1994 Peddie
5,325,787 A 7/1994 Boual
5,399,187 A 3/1995 Mravic et al.
5,527,376 A 6/1996 Amick et al.
5,594,186 A 1/1997 Krause et al.
5,597,975 A 1/1997 Satow
5,719,352 A 2/1998 Griffin
5,763,819 A 6/1998 Huffman
5,822,904 A * 10/1998 Beal ..... 42/76.01
6,048,379 A 4/2000 Bray et al.

* cited by examiner

METHOD FOR DEVELOPING AND SUSTAINING UNIFORM DISTRIBUTION OF A PLURALITY OF METAL POWDERS OF DIFFERENT DENSITIES IN A MIXTURE OF SUCH METAL POWDERS

RELATED APPLICATIONS

The present application is a continuation-in-part of applications Ser. No. 08/887,774, filed Jul. 3, 1997, entitled: JACKETED PROJECTILE FOR USE IN SUBSONIC AMMUNITION FOR SMALL-BORE SEMI-AUTOMATIC OR AUTOMATIC WEAPONS AND METHOD FOR MAKING SAME now abandoned; which is a continuation-in-part of Ser. No. 08/843,450 filed Apr. 16, 1997, now abandoned, which is a continuation-in-part of Ser. No. 08/815,003 filed Mar. 14, 1997 now U.S. Pat. No. 5,822,904, other applications of interest are Ser. No. 09/264,072, filed Mar. 8, 1999, entitled: METHOD FOR THE MANUFACTURE OF A MULTI-PART PROJECTILE FOR GUN AMMUNITION AND PRODUCT PRODUCED THEREBY now U.S. Pat. No. 6,317,946; Ser. No. 08/888,270, filed Jul. 3, 1997, entitled: PLATED PROJECTILE FOR USE IN SUBSONIC AMMUNITION FOR SMALL-BORE SEMI-AUTOMATIC OR AUTOMATIC WEAPONS AND METHOD FOR MAKING SAME now abandoned; Ser. No. 08922,129 filed Aug. 28, 1997, entitled: PROJECTILE FOR AMMUNITION CARTRIDGE, now U.S. Pat. No. 5,847,313; Ser. No. 08/792,578, filed Jan. 30, 1997, entitled: PROJECTILE FOR AMMUNITION CARTRIDGE now U.S. Pat. No. 5,789,698; Ser. No. 09/220,087, filed Dec. 23, 1998, entitled: SMALL BORE FRANGIBLE AMMUNITION PROJECTILE now abandoned; Ser. No. 09/198,823, filed Nov. 24, 1998, entitled: METHOD FOR THE MANUFACTURE OF A FRANGIBLE NONSINTERED POWDER-BASED PROJECTILE FOR USE IN GUN AMMUNITION AND PRODUCT OBTAINED THEREBY, now U.S. Pat No. 6,457,417.

FIELD OF INVENTION

The present invention relates to mixtures of metal powders and specifically with a method for developing and sustaining uniform distribution of first and second dissimilar metal powders, in particular metal powders having substantially differing densities.

BACKGROUND OF INVENTION

In the prior art it is well recognized that in a mixture of metal powders having different masses (densities), it is difficult to obtain such mixing of the powders as will result in uniform distribution of the particles of one powder or powders with the particles of one or more of the other powder or powders without subsequent separation of the different metal powders according to their respective densities. This problem may occur when mixing two metal powders or when mixing more than two metal powders. Blending of the metal powders, in their dry state, is commonly used to obtain a mixture of two or more metal powders. Even with well-blended powder mixtures, substantially any vibration, even slight vibration, of the mixture can result in separation of the powders as a function of their respective densities. Consequently, division of a blended mixture of metal powders into aliquots for any of various reasons, such as for loading of a measured quantity of the powder mixture into a die cavity, frequently results in material differences in the overall density of the aliquots. Moreover, the powder distribution within the aliquot ceases to be uniform, resulting in a non-uniform density distribution within the resulting die-pressed product.

In the art of manufacturing powder mixture-based ammunition projectiles, it is common to press a measured quantity of the powder mixture in a die cavity to obtain a self-supporting core from which the projectile is subsequently produced. Accuracy of delivery of the projectile to a target and repeatability of performance of the projectile with respect to its muzzle velocity, its flight characteristics to a target, and/or its terminal ballistics are highly desired and in certain instances, extremely critical. Use of this type ammunition in law enforcement and military applications demands very exacting standards of performance of the projectile and the same performance from projectile to projectile. The present inventor has found that even small disparities in the desired mass (density) of each projectile and like small disparities in the uniformity of density distribution of the formed projectiles can be unacceptable.

Prior to the present invention, it has been proposed that projectiles for gun ammunition be "powder-based", that is, the projectile is formed by die-pressing one or more metal powders into a self-supporting compact. This activity is fraught with problems and/or difficulties, such as choice of powders, uniformity of mixing of the metal powders, sustaining uniformity of mixing of the powders during die-loading procedures, selection of pressures and techniques, such as selection of die lubricants and/or sintering or the like, to ensure production of a self-supporting compact suitable for further processing, and many other problems and/or difficulties. As noted hereinabove, a major concern in the manufacture of powder-based projectiles for gun ammunition relates to the uniformity of density distribution of the powders within a mixture within the projectile. The present inventor has discovered that in the production of projectiles for use in gun ammunition, the performance of the projectiles, when incorporated into a round of ammunition and fired, is a function of the uniformity of distribution of the density of the projectile, both the density distribution in a direction radially of the longitudinal centerline of a cylindrical compact which is to be incorporated into a projectile and the location of the center of gravity of the projectile (nutation effect). Very importantly, every projectile of a desired given size, weight, density distribution, etc., needs to be consistently the same from projectile to projectile.

In the prior art, it has been suggested that a mixture of tungsten metal powder be mixed with a lighter metal powder, such as tin, lead or the like, be used in the production of a powder-based gun ammunition projectile. The difference between the densities of these two metal powders (or other mixtures of two or more metal powders) gives rise to serious and deleterious separation of the tungsten particulates from the tin particulates within a mixture of these two metal powders into striations or layers of primarily tungsten particulates and tin particulates. This separation of the powders (1) precludes division of the powder mixture into aliquots of a given quantity of tungsten powder and a given quantity of tin powder, and (2) uniformity of density distribution of the powders as the mixture is vibrated, etc. in the course of the aliquoting and in the process of pouring the powder into a die cavity.

It is therefore an object of the present invention to provide a method of developing and sustaining uniform distribution of the individual particulates of a plurality of metal powders in a mixture thereof.

It is another object to provide a method for obtaining aliquots of a powder mixture wherein each of the aliquots is of essentially equal density and exhibits essentially uniform density distribution throughout the aliquot.

It is another object to provide an improved die-pressed compact for use in the manufacture of an ammunition projectile.

It is another object to provide a method for the production of a plurality of ammunition projectiles having essentially equal density and each having essentially uniform density distribution throughout the projectile.

These and other objects of the present invention will be recognized from the description contained herein including the claims and the drawings.

SUMMARY OF INVENTION

Figure 1:
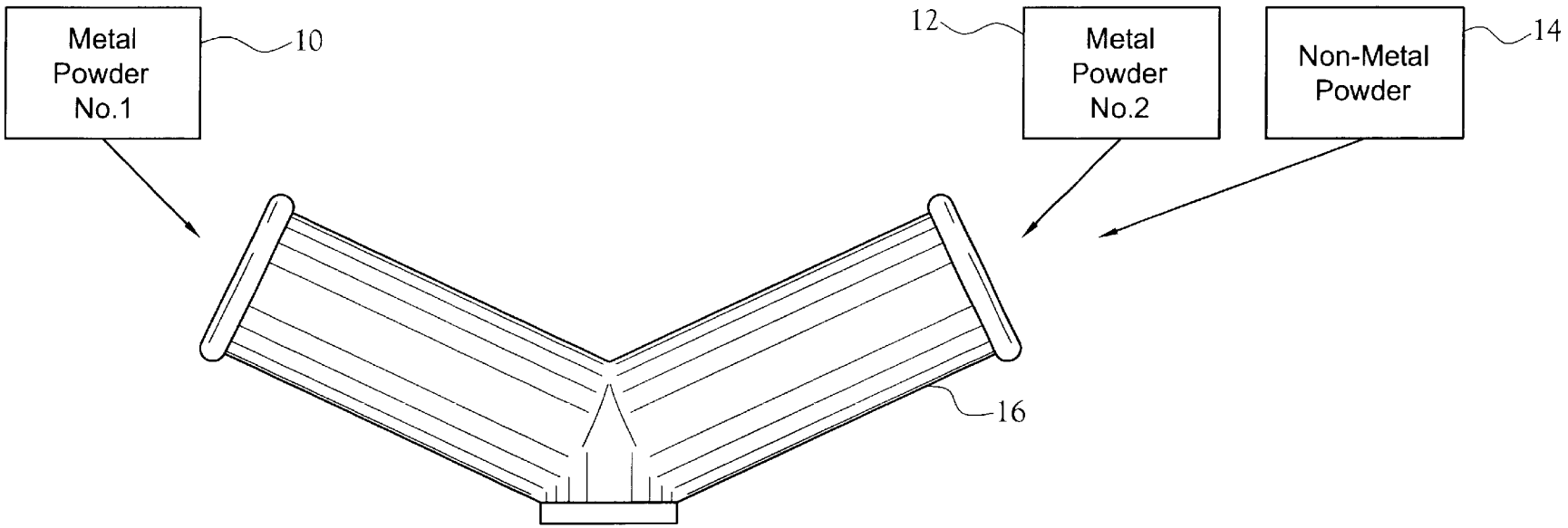
FIG. 1 is a schematic representation of the steps of one embodiment of the method of the present invention.

The present invention comprises a method by which the distribution of the particulates of a plurality of metal powders having different densities, may be uniformly disbursed within a dry mixture of the powders and by which this uniform dispersion of the different density powders can be sustained through subsequent handling and/or storage of the mixture. In accordance with one aspect of the present invention, a quantity of each of a plurality of metal powders is admixed with a dry stabilizing non-metal powder. One particularly useful non-metal powder is a micronized polymer, preferably micronized polyethylene. Surprisingly, this non-metal powder has been discovered by the present inventor to reduce striation and/or like separation of heavy (dense) metal powder, tungsten metal powder, for example, from light (less dense) metal powder, tin metal powder, for example, after the heavy metal powder and light metal powder have been mixed, as in a common V-blender, in the presence of a surprisingly small quantity of the non-metal powder. This stability of dispersion of the metal powders, despite their vastly differing densities, has been found to continue through such activities as pouring of the mixture from container to container, aliquoting of the mixture, and die pressing of the mixture, for example.

Whereas the exact mechanism by which the stabilizing non-metal powder effects the development and stabilization of uniform distribution of the particulates of the several metal powders, despite their differences in densities, if it strongly suspected, that the blending of the metal powders with the polymeric powder, which can acquire and hold an electrostatic charge, may form some kind of electrical bond between the metal and non-metal powder particles and/or a form of mechanical bond between these powders. In any event, the strength of the force or forces which develop and sustain the uniform distribution of the metal powder particles throughout the mixture has been found to be sufficient to resist the tendency of the heavier metal particles to separate from the lighter metal particles after the powders have been blended.

DETAILED DESCRIPTION OF INVENTION

In the present specification, the term "metal powder" is intended to include elemental metal powders and/or metal alloy powders unless the context indicates otherwise.

In one embodiment of the present invention, a quantity of a first metal powder having a first density is blended with at least a second metal powder having a second density which is less or greater than the first density, in the presence of a stabilizing dry non-metal powder. Any two or more metal powders having different densities may be blended, employing the present invention, into a mixture thereof which exhibits a sustained uniform distribution of the particles of the metal powders throughout the mixture. This uniformity of distribution of the particles of the several metal powders which make up the mixture has been found to be sustained through subsequent manufacturing operations involving the mixture, such as transfer between containers, storage, aliquoting, etc. Such uniformity of particle distribution yields uniformity of the overall density of the mixture throughout the mixture. Since the uniform density of the mixture of powders carries over into products produced from the mixture of metal powders, the product so produced exhibits uniformity of density. Metal alloy powders of different densities, also may be successfully processed employing the present invention, either as free powders or in combination with one or more non-alloy metal powders.

Preferably, the particulates of each of metal powders are generally of about the same particle size. Exactness of particle size is not required, but best performance is obtained when at least about 80% of the particles of a given metal powder are within a relatively small range of particle sizes. Most preferably, at least about 80% of metal powder particles are of an average particle size of less than about 200 mesh and no material portion of the metal powder particulates is of a particle size greater than about 200 mesh. Metal powder particle sizes of about 325 mesh or smaller appear to enhance the benefits of the present invention.

The stabilizing powder of the present invention preferably exhibits a particle size in the low micron range, ie., between about 6 microns and about 18 microns and is of a relatively low density. Larger or smaller particle sizes appear to diminish the desired effect of the stabilizing powder. Preferably, the stabilizing third powder comprises a dry micronized polyolefin powder. This third powder appears to be most effective when it carries an electrostatic charge. Whereas various polymeric powders appear to be useful, a preferred dry micronized polyolefin powder, most preferably a dry micronized polyethylene powder having a particle size between about 6 microns and about 18 microns, and a density of about 0.99 g/cc, is employed most effectively. As noted, the mechanism by which the stabilizing powder effects the development and stabilization of uniform density distribution of the metal powders of the mixture is unknown with certainty. It appears, however, that there may be either or both electrostatic and mechanical forces involved.

Most surprisingly, the present inventor has found that the quantity (by weight) of stabilizing powder which is required is very small relative to the weight of the metal powders being mixed. For example, in most metal powders, almost irrespective of what combination of metal powders is being mixed, only between about 0.008% and about 1.5%, by weight, of the stabilizing powder is practically effective. Most preferably, about 0.015%, by weight, of a micronized polyolefin powder is employed. Greater or lesser amounts of the stabilizing powder have lessened effect on the development and stabilization of the uniformity of distribution of the powders within the final mixture, and in all known instances, greater that about 1.5%, by weight, of the stabilizing powder materially diminishes the effectiveness of the stabilizing powder. One suitable micronized polymer powder is fine particle size oxidized polyethylene powder available from Allied Signal Inc., Morristown, N.J., as ACumist® A-12.

In instances where the powder mixture is divided into aliquots and thereafter each aliquot is die pressed into a self-supporting compact, the presence of the non-metal powder in the product has not been noted to deleteriously affect the intended use of the compact. However, if desired, the non-metal powder may be removed from the compact as by heating of the compact above the volatilization temperature of the non-metal powder.

Beneficially, the present inventor has found that, in the manufacture of powder-based projectiles for gun ammunition, the presence of the non-metal powder within the projectile has no detectable deleterious effect upon either the performance of a projectile or consistency of performance from projectile to projectile.

In one example, the present inventor blended dry tungsten metal powder 10 (see FIG. 1) with tin metal powder 12 in the presence of a dry micronized polyolefin 14 in a common V-blender 16. The polyolefin employed was a fine grain oxidized polyethylene homopolymer having a density of 0.99 g/cc, an average particle size of 12 microns. Different relative quantities of tungsten powder and tin powder ranging from about 1% to 99%, by weight, of tungsten powder and from about 99% to 1%, by weight, of tin powder were tested, each combination being blended in a V-blender for about 30 minutes with about 0.01%, by weight of micronized polyethylene powder. About 80% of the particles of each of the tungsten and tin powders was less than about 325 mesh. In all instances, the particles of the blended tungsten and tin powders were uniformly distributed throughout the mixture. The mixture was poured from the blender into a receptacle and subsequently was divided into equal weight aliquots. Each aliquot was die pressed into a self-supporting compact which, in turn, was incorporated into a gun ammunition projectile. Each projectile so formed performed essentially like every other of the projectiles so formed, when fired from a gun to a target. Morever, the accuracy of the flight of each projectile to the target was found to be materially improved over prior known powder-based projectiles. Thus, the present invention has particular usefulness in the manufacture of projectiles for use in gun ammunition.

Table I presents a listing of many of the different combinations of metal powders, in addition to the example given hereinabove, which have been found to be successfully processed employing the present invention. Each combination of metal powders was blended for 30 minutes in a laboratory V-blender, removed from the blender and examined for uniformity of distribution of the metal powders of the mixture. All exhibited excellent uniformity of such distribution. The non-metal powder employed in these tests was a micronized polyethylene powder.

TABLE I

| Powder No. 1 | Weight % | Powder No. 2 | Weight % |
|---|---|---|---|
| W | 90 | Fe | 10 |
| W | 10 | Fe | 90 |
| W | 90 | Sn | 10 |
| W | 50 | Sn | 50 |
| W | 10 | Sn | 90 |
| W | 90 | Zn | 10 |
| W | 10 | Zn | 90 |
| W | 50 | Zn | 50 |
| W | 90 | thermite | 10 |
| W | 90 | thermite + Sn | 10 |
| W | 90 | Mg | 10 |
| W | 90 | Al | 10 |
| W | 90 | Nickel steel | 10 |
| W | 90 | Fe + Sn | 10 |

Numerous other mixtures of metal powders, different weight percentages of the listed metal powders, and other combinations of metal powders also have been tested. In all instances, the powders did not separate based upon their relative densities. Further, the density of each mixture was found to be uniform throughout the mixture and in aliquots of the mixture.

It is to be noted that, for convenience, the weight percentages of all of the metal powders of a mixture referred to herein ignore the weight percentage of the non-metal powder because of the relatively extreme small (most preferably about 0.015 wt. %) contribution of the weight of the non-metal powder to the overall weight of the mixture of the metal and non-metal powders.

Further, surprisingly, when processing any of the powders tested by the inventor, there did not appear to be any material difference in the weight percentage of non-metal powder to be employed. That is, irrespective of what combination of metal powders was employed, between about 0.008 wt. % and about 1.5 wt. % of the non-metal powder functioned satisfactorily when the average particle size of the particulates of the metal powders was less than 200 mesh. Larger particle size metal powders have been found to be less responsive to the presence of the non-metal powder.

Whereas the present invention has been described in specific terms, one skilled in the art will recognize permissible variations and combinations of the elements of the invention, and it is intended to limit the invention only as set forth in the claims appended hereto.

What is claimed:

1. A method of developing and sustaining uniform distribution of a plurality of dry metal powders of differing densities within a dry mixture of the powders comprising the steps of blending a quantity of at least a first dry powdered form of a metal having a density greater than the density of lead and a second dry powdered form of a metal having a density not greater than the density of lead with a quantity of a dry micronized polymeric powder for a time sufficient to intersperse the powders uniformly throughout a dry mixture thereof, said dry powders of said mixture being sustained against separation of the dry powder particles of the mixture as a function of their respective densities.

2. The method of claim 1 wherein said micronized polymeric powder comprises a polyolefin powder.

3. The method of claim 1 wherein said polymeric powder carries an electrostatic charge on the particles thereof.

4. The method of claim 1 wherein said polymeric powder exhibits a particle size between about 6 microns and about 18 microns.

5. The method of claim 1 wherein said polymeric powder has a density of less than about 1 g/cc.

6. The method of claim 1 wherein said polymeric powder is present in an amount of between about 0.008% and about 1.5%, by weight, of the total weight of the powders in the mixture.

7. The method of claim 1 including the steps of dividing the resultant mixture of powders into aliquots, die pressing each aliquot into a self-supporting compact, and incorporating each compact into a gun ammunition projectile.

8. A gun ammunition projectile formed from a compact formed by the method of claim 7.

9. The method of claim 1 wherein the particle size of the each of the metal powders is less than about 200 mesh.

10. A method of developing and sustaining a mixture of uniformly distributed dry metal powders of different densities comprising the steps of introducing a quantity of each of the dry metal powders into a blender, introducing a quantity of a non-metal stabilizing dry powder into the blender with the metal powders, blending the metal powders and the stabilizing dry powder for a time sufficient to develop a uniform distribution of the metal powders throughout the mixture and stabilization of said dry metal powders against separation of said dry metal powders of the mixture as a function of their respective densities.

11. The method of claim 10 wherein said stabilizing dry powder comprises a micronized polyolefin powder.

12. The method of claim 10 wherein said stabilizing dry powder comprises a dry micronized polyethylene powder which is present in a quantity of between about 0.008% and about 1.3%, by weight, of the total weight of the metal powders, is of an average particle size of about 12 microns, and has a density of about 0.99 g/cc.

13. The method of claim 10 wherein said stabilizing powder carries an electrostatic charge on the particles thereof.

14. The method of claim 10 wherein said dispersion of said dry metal powders is sustained when said mixture of dry powders is subjected to events and/or forces which tend to encourage the separation of said dry metal powders as a function of their respective densities.

15. The method of claim 1 wherein said dispersion of said dry metal powders is sustained when said mixture of dry powders is subjected to events and/or forces which tend to encourage the separation of said dry metal powders as a function of their respective densities.

16. A mixture of at least a first dry metal powder having a density greater than the density of lead, at least a second dry metal powder having a density not greater than the density of lead and between about 0.08% and about 1.5%, by weight, of a polymeric powder having a density not materially greater than 1 gm/cc, said mixture exhibiting substantially no separation of said powders based upon their relative densities upon agitation of said mixture by events and/or forces which tend to cause separation of said dry metal powders in the course of activities such as storage, transfer, and/or aliquoting of said mixture.

17. The mixture of claim 16 wherein said polymeric powder comprises a dry micronized polyolefin powder.

18. The mixture of claim 17 wherein said polyolefin powder has a particle size between about 6 and about 18 microns.

19. The mixture of claim 16 wherein said polymeric powder exhibits an electrostatic charge associated with the powder particles thereof.

20. The mixture of claim 16 wherein said at least first metal powder is present within said mixture in a percentage by weight amount which is sufficient to produce a mixture having a density not less than the density of lead.

* * * * *